US008210797B2

(12) United States Patent
Dueckershoff et al.

(10) Patent No.: US 8,210,797 B2
(45) Date of Patent: Jul. 3, 2012

(54) GAS TURBINE WITH A STATOR BLADE

(75) Inventors: Roland Dueckershoff, Hoehr-Grenzhausen (DE); Ulrich Steiger, Baden-Daettwil (CH); Ulrich Rathmann, Baden (CH)

(73) Assignee: ALSTOM Technology Ltd, Baden (CH)

( * ) Notice: Subject to any disclaimer, the term of this patent is extended or adjusted under 35 U.S.C. 154(b) by 44 days.

(21) Appl. No.: 12/954,205

(22) Filed: Nov. 24, 2010

(65) Prior Publication Data

US 2011/0085894 A1 Apr. 14, 2011

Related U.S. Application Data

(63) Continuation of application No. PCT/EP2009/055768, filed on May 13, 2009.

(30) Foreign Application Priority Data

May 26, 2008 (CH) ..... 0790/08

(51) Int. Cl.
*F01D 9/00* (2006.01)

(52) U.S. Cl. ..... 415/115; 415/209.3; 415/213.1; 415/177

(58) Field of Classification Search ..... 415/115, 415/209.3, 213.1, 177
See application file for complete search history.

(56) References Cited

U.S. PATENT DOCUMENTS

| | | | | |
|---|---|---|---|---|
| 3,427,000 | A * | 2/1969 | Scalzo | 415/108 |
| 3,781,125 | A * | 12/1973 | Rahaim et al. | 415/115 |
| 4,187,054 | A * | 2/1980 | Landis et al. | 415/115 |
| 4,932,861 | A | 6/1990 | Keller et al. | |
| 5,098,257 | A * | 3/1992 | Hultgren et al. | 415/115 |
| 5,588,826 | A | 12/1996 | Döbbeling et al. | |
| 5,813,835 | A | 9/1998 | Corsmeier et al. | |
| 6,227,798 | B1 | 5/2001 | Demers et al. | |
| 6,431,820 | B1 | 8/2002 | Beacock et al. | |

FOREIGN PATENT DOCUMENTS

| | | |
|---|---|---|
| DE | 20 65 334 A1 | 4/1973 |
| DE | 103 06 915 A1 | 9/2004 |
| DE | 10 2005 013 795 A1 | 9/2006 |
| EP | 0 321 809 A1 | 6/1989 |
| EP | 0 704 657 A2 | 4/1996 |
| EP | 1 798 380 A2 | 6/2007 |

OTHER PUBLICATIONS

International Search Report (PCT/ISA/210) issued on Sep. 7, 2009, by European Patent Office as the International Searching Authority for International Application No. PCT/EP2009/055768.
Search Report issued on Sep. 7, 2009, by Swiss Patent Office for Application No. 7902008.
Joos et al., "Field Experience of the Sequential Combustion System for the GT24/GT26 Gas Turbine Family", The American Society of Mechanical Engineers, 1998, pp. 1-8.

* cited by examiner

*Primary Examiner* — Ninh H Nguyen
(74) *Attorney, Agent, or Firm* — Buchanan Ingersoll & Rooney PC

(57) ABSTRACT

A gas turbine with a stator blade is disclosed. The stator blade is fastened on a blade carrier and includes a blade airfoil which extends inwards in the radial direction from an outer platform into a hot gas passage. A cooling medium can flow through an interior of the blade airfoil, such as cooling air, which flows through an access in the blade carrier into a first plenum which is arranged above the outer platform, and from there, via an inlet which is provided in the outer platform, flows into the interior of the blade airfoil.

19 Claims, 5 Drawing Sheets

GAS TURBINE WITH A STATOR BLADE

RELATED APPLICATIONS

This application claims priority as a continuation application under 35 U.S.C. §120 to PCT/EP2009/055768, which was filed as an International Application on May 13, 2009, designating the U.S., and which claims priority to Swiss Application 00790/08 filed in Europe on May 26, 2008. The entire contents of these applications are hereby incorporated by reference in their entireties.

FIELD

The disclosure relates to the field of gas turbine technology, in particular, a gas turbine with a stator blade.

BACKGROUND INFORMATION

Gas turbines with sequential combustion are known and have been useful in industrial operation.

A gas turbine, known as GT24/26, is disclosed, for example, in an article by Joos, F. et al., "Field Experience of the Sequential Combustion System for the ABB GT24/GT26 Gas Turbine Family", IGTI/ASME 98-GT-220, 1998 Stockholm. FIG. 1 of this publication is reproduced in the present application as FIG. 1. Furthermore, such a gas turbine is disclosed in EP-B1-0 620 362.

FIG. 1 shows a gas turbine 10 with sequential combustion, in which a compressor 11, a first combustion chamber 14, a high-pressure turbine (HPT) 15, a second combustion chamber 17 and a low-pressure turbine (LPT) 18 are arranged along an axis 19. The compressor 11 and the two turbines 15, 18 are part of a rotor which rotates around the axis 19. The compressor 11 draws in air and compresses it. The compressed air flows into a plenum and from there into premix burners where this air is mixed with at least one fuel which is introduced via the fuel supply 12. Such premix burners are disclosed, for example, in EP-A1-0 321 809 and EP-A2-0 704 657.

The compressed air flows into the premix burners, where the mixing with at least one fuel takes place. This fuel/air mixture then flows into the first combustion chamber 14, in which this mixture can be combusted, forming a stable flame front. The hot gas which is thus made available is partially expanded in the adjoining high-pressure turbine 15, performing work, and then flows into the second combustion chamber 17 where a further supply 16 of fuel can take place. As a result of the high temperatures which the hot gas, which is partially expanded in the high-pressure turbine 15, still has, a combustion, which is based on self-ignition, takes place in the second combustion chamber 17. The hot gas which is reheated in the second combustion chamber 17 is then expanded in a multistage low-pressure turbine 18.

The low-pressure turbine 18 includes a plurality of rows, arranged in series in the flow direction, of rotor blades and stator blades, which can be arranged in alternating sequence. For example, the stator blades of the third stator blade row in the flow direction are provided with the designation 20' in FIG. 1.

With the high hot-gas temperatures of gas turbines of the latest generation, it is desirable to cool the stator blades and rotor blades of the turbine. For this, a gaseous cooling medium (for example compressed air from the compressor of the gas turbine or steam if the gas turbine is part of a combined cycle power generating plant) can be delivered through cooling passages (frequently extending in a serpentine manner) which can be arranged in the blade, and/or discharged outwards at different points of the blade through corresponding openings (holes, grooves), for example, to form a cooling film on the outer side of the blade (film cooling). An example of such a cooled blade is disclosed in U.S. Pat. No. 5,813,835.

Cooling of the platforms, in particular the outer platform of a gas-turbine stator blade, in which special cooling holes and impingement cooling techniques are used, is known, for example, from printed publication DE-A1-10 2005 013 795. Such cooling devices and cooling techniques, however, require a comparatively high production and installation outlay.

SUMMARY

A gas turbine is disclosed including a stator blade fastened on a blade carrier. The stator blade includes a blade airfoil which extends inwards in a radial direction from an outer platform into a hot gas passage. An access in the blade carrier into a first plenum is arranged above the outer platform for a cooling medium to flow, via an inlet provided in the outer platform, into an interior of the stator blade. A first means controls the cooling-medium pressure in the first plenum. A second means cools the outer platform by directing the cooling medium from the first plenum.

BRIEF DESCRIPTION OF THE DRAWINGS

The disclosure shall subsequently be explained in more detail based on exemplary embodiments in conjunction with the drawings. All elements which are not essential for the direct understanding of the disclosure have been omitted. Like elements are provided with the same designations in the various figures. The flow direction of the media is indicated by arrows. In the drawing

DETAILED DESCRIPTION

The disclosure relates to the case of the gas-turbine stator blade, to provide simplified and efficient cooling of the outer platform.

In an exemplary embodiment of the disclosure first means for controlling controls a cooling-medium pressure in a first plenum above an outer platform of a stator blade and second means effects cooling of the outer platform by a cooling medium which escapes in a directed manner from the first plenum. As a result of this, leakage cooling medium which escapes in a directed manner can be used for cooling the outer platform before it flows out into the hot gas passage.

According to the disclosure, the first means can be arranged in the region of the first plenum. The first means includes a throttling element which throttles the flow of cooling medium through the inlet in the outer platform. The throttling element can be formed as a plate which covers the inlet except for one or more, for example circular, throttling openings which are provided in the plate.

In an exemplary embodiment of the disclosure, access to the first plenum can be formed as a throttling opening. As a result of the throttling devices, the pressure in the first plenum and leakage of the cooling medium from the plenum can be adjusted.

Two outwardly projecting, for example, hook-like fastening elements, for fastening the stator blade on the blade carrier, can be formed on the upper side of the outer platform at a distance from each other. The first plenum can be formed between the two fastening elements.

The second means can include a second plenum which can be arranged on the side of the one fastening element facing away from the first plenum. The second plenum can be supplied from the first plenum with cooling medium which escapes from there, and the second plenum can be in communication with the hot gas passage via throttling means.

Furthermore, the gaps which exist between adjacent stator blades of a stator-blade row can be sealed against the hot gas passage by sealing strips which can be inserted in corresponding sealing grooves in the lateral surfaces of the outer platforms of the stator blades. The sealing strips can be formed as throttling means in the region of the second plenum and in the region of the second plenum can be formed shorter and/or considerably thinner than the associated sealing grooves for achieving a throttling effect.

In an exemplary embodiment of the disclosure the second plenum can be partially delimited by a heat shield segment which is adjacent to the outer platform of the stator blade in the flow direction of the hot gas flow. A stepped gap, via which the second plenum is in communication with the hot gas passage, can be arranged between the heat shield segment and the outer platform towards the hot gas passage.

Figure 1:
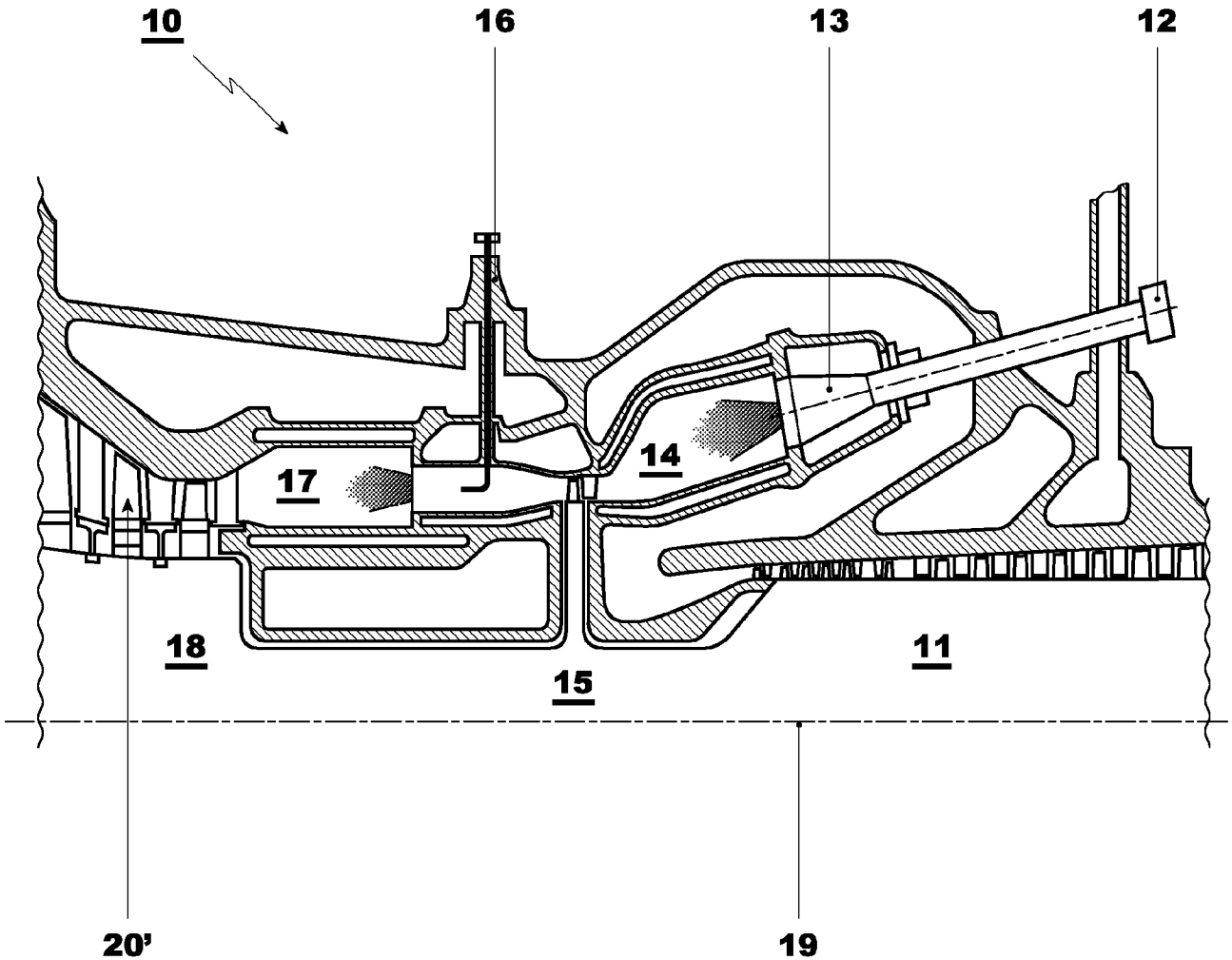
FIG. 1 shows the basic construction of a known gas turbine with sequential combustion.
Figure 2:
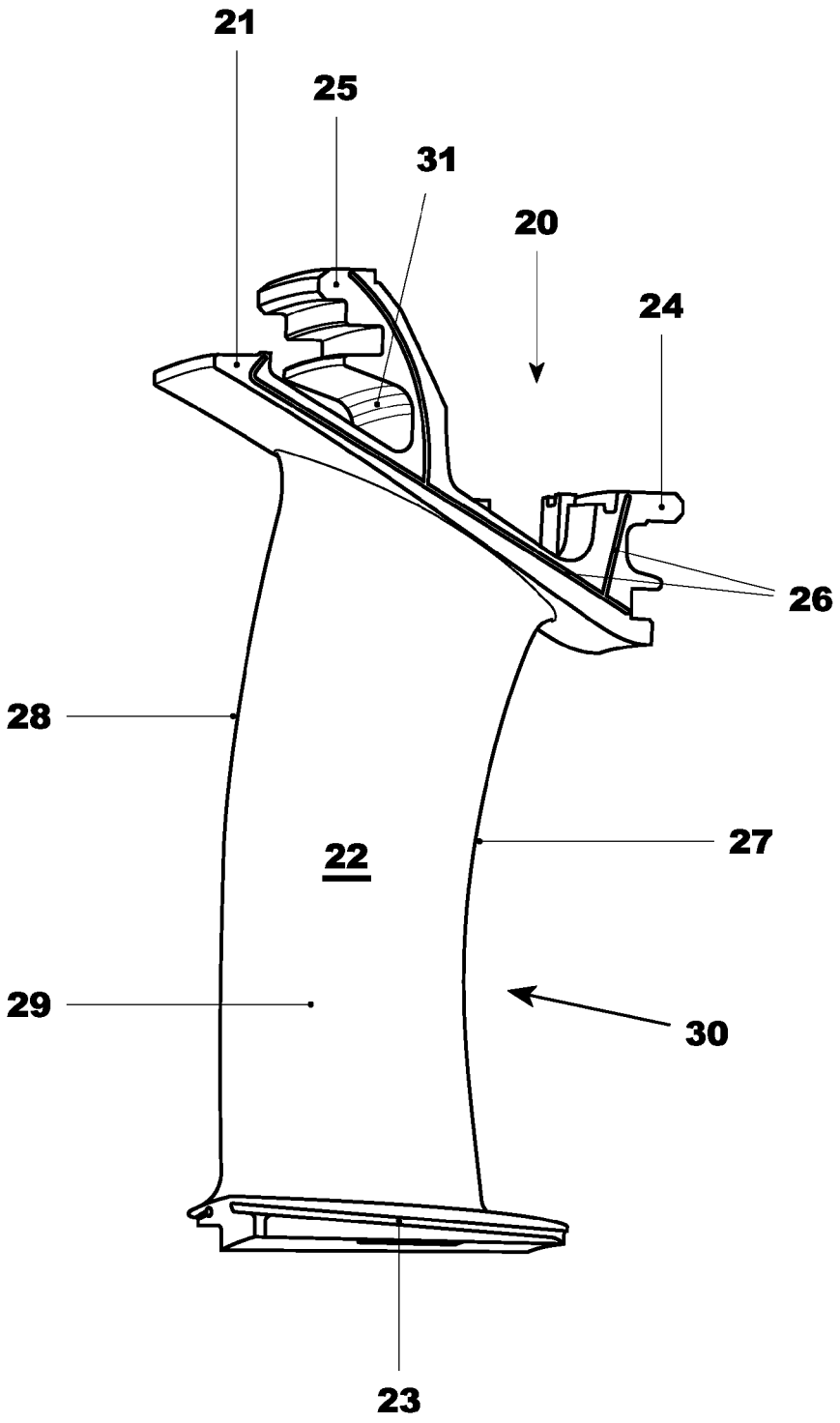
FIG. 2 shows in a perspective side view a stator blade for an exemplary embodiment of the disclosure.

FIG. 2 shows in a perspective side view, an exemplary embodiment of a stator blade which, for example, can be used in the low-pressure turbine of a gas turbine with sequential combustion according to the disclosure.

The disclosure, however, is not limited to a said gas turbine type nor to a special stator blade or rotor blade.

The stator blade 20 can include a blade airfoil 22 which can be sharply curved in space and in the longitudinal direction (in the radial direction of the gas turbine) extends between blade tip 23 and an outer platform 21 and in the direction of the hot gas flow 30 reaches from a leading edge 27 to a trailing edge 28. Between the two edges 27 and 28, the blade airfoil 22 can be delimited on the outside by a suction side 29 and an (oppositely disposed) pressure side (not to be seen in FIG. 2).

The stator blade 20, by a hook-like fastening elements 24 and 25 which are formed on the upper side of the outer platform 21, can be fastened on the blade carrier (38 in FIG. 5), while by the blade tip 23 it butts against the rotor with sealing effect. The space between the fastening elements 24 and 25, in the installed state of the stator blade (FIG. 5), forms a first plenum (41) for the cooling air, while on the other side of the fastening element 25, in the installed state of the stator blade (FIG. 5), a pronounced hollow 31 can be made a second plenum (42). Sealing grooves, which accommodate sealing strips for sealing the gaps between adjacent stator blades of a blade ring, can be arranged in the lateral surfaces of the upper platform 21. A core exit 32, which results in the outer platform 21 from the casting process, is closed off in a flush and therefore flow-favorable manner by a sealing plug, which is not shown in more detail.

Figure 6:
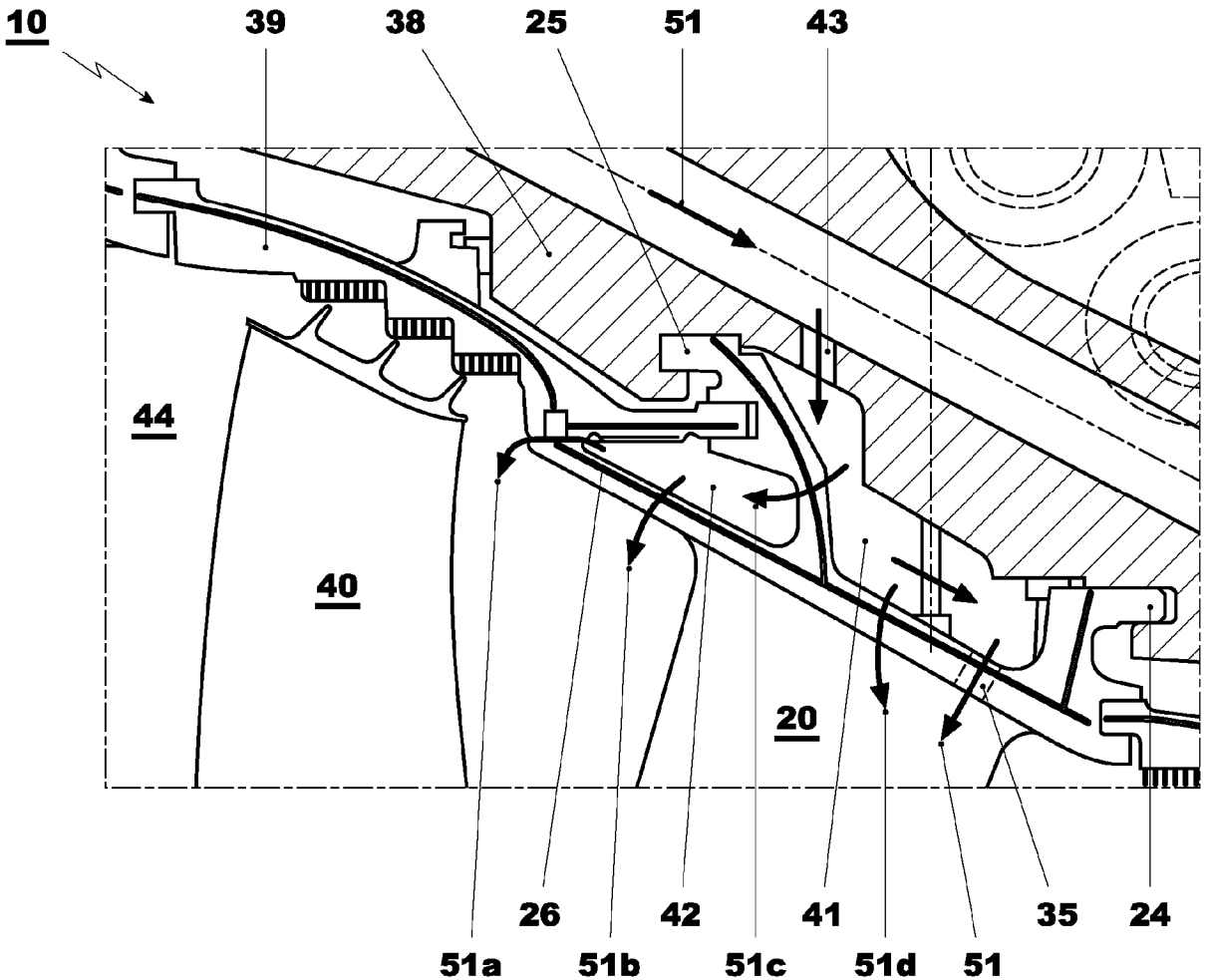
FIG. 6 shows in a side view the fastening of the stator blade from FIG. 2 in the gas turbine.

Provision is made in the interior of the blade airfoil 22 for cooling devices (cooling passages, cooling ribs, impingement cooling elements, etc.) (not shown in the figures) which according to FIG. 4 can be used with an inlet 36 in the upper platform 21 with a cooling medium (cooling air). The cooling medium which flows into the blade can originate from the first plenum 41 above the outer platform (FIG. 6), into which plenum it finds its way through a throttling opening 43 in the blade carrier 38.

Figure 3:
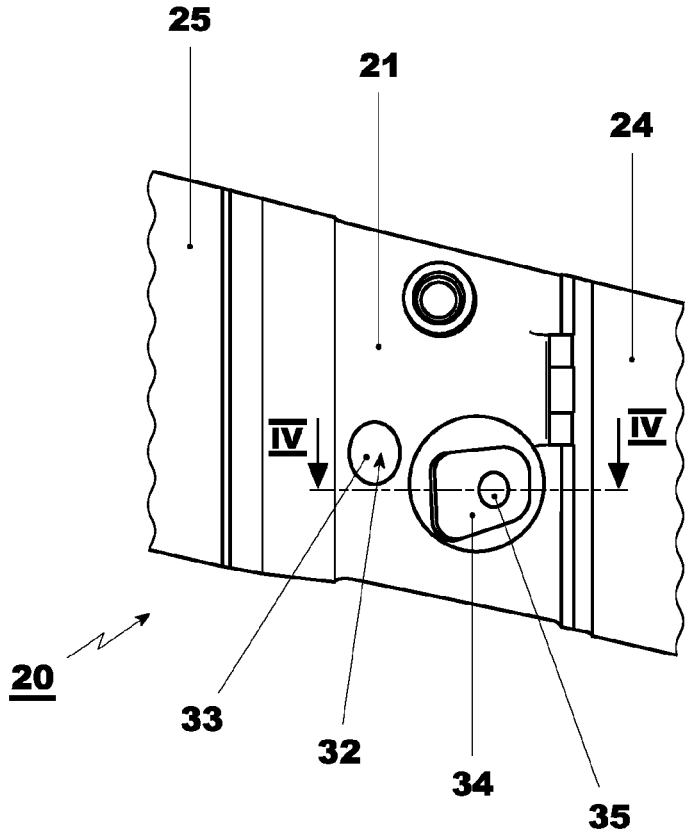
FIG. 3 shows in plan view from above the outer platform of the stator blade from FIG. 2 with the throttling element arranged at the outlet of the first plenum.
Figure 4:
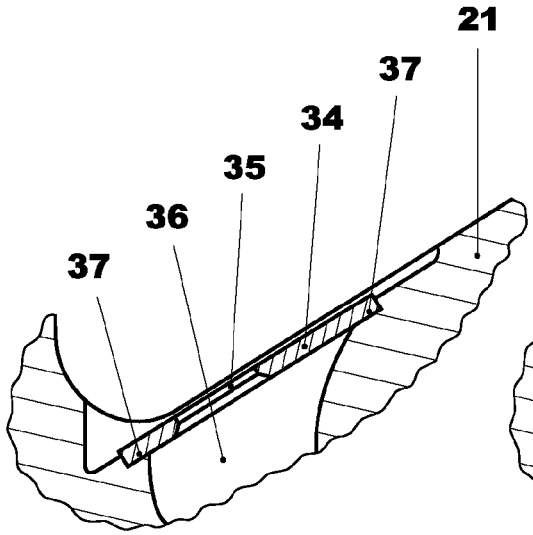
FIG. 4 shows the section in the plane IV-IV in FIG. 3 through the throttling element.
Figure 5:
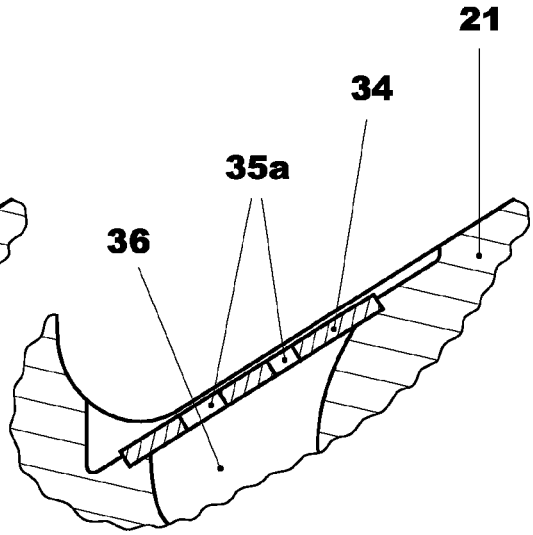
FIG. 5 shows the section through the throttling element according to FIG. 4, wherein the throttling element has a plurality of throttling openings.

As is evident from FIGS. 3 and 4, the comparatively large cross section of the inlet 36 can be closed off by a plate-like throttling element 34 which is inserted in a flush manner and frees one (see FIG. 4, item 35) or more throttling openings of smaller diameter (see FIG. 5, item 35*a*). By matching the two free cross sections of the throttling openings 35 or 35*a* and 43 to one another, the pressure of the cooling medium 51 in the first plenum can be efficiently controlled and adjusted. At the same time, the adjusted pressure brings about a directed (controlled) leakage of the cooling medium 51*c* from the first plenum 41 into the adjacent second plenum 42 and to the part of the outer platform 21 which forms the wall of the hot gas passage 44. As a result of this, the outer platform 21, without further constructional measures, can be cooled in a simple, reliable and easily adjustable manner by leakage cooling medium 51*a*-51*d* from the cooling of the blade airfoil (curved arrows in FIG. 6).

Figure 7:
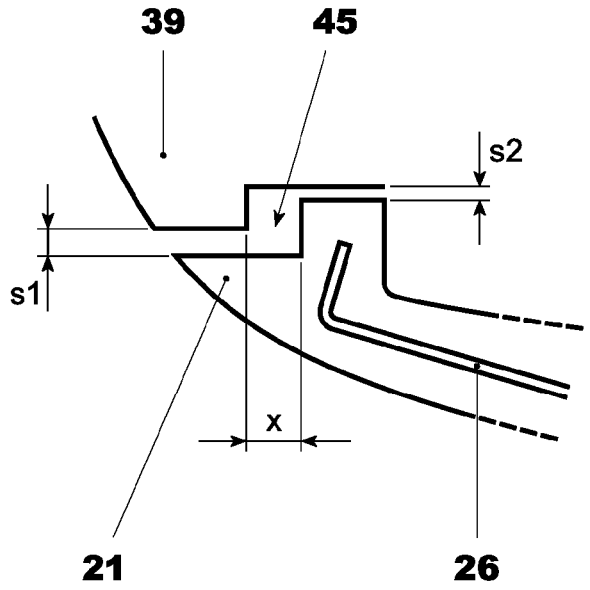
FIG. 7 shows the design of the stepped gap between second plenum and hot gas passage according to an exemplary embodiment of the disclosure.
Figure 8:
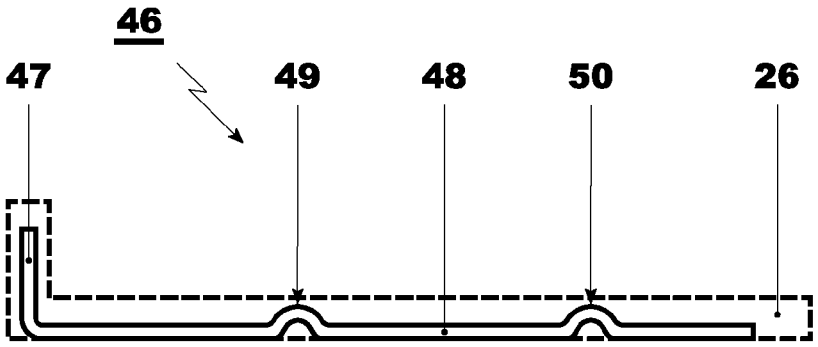
FIG. 8 shows the sealing strip, formed as a throttling means, between adjacent outer platforms according to exemplary embodiment of the disclosure.

The use of the cooling medium which has flown into the second plenum 42 for cooling the outer platform 21 can be influenced by two measures which can be seen more clearly in FIGS. 7 and 8: A sealing strip 46 can be inserted in the sealing groove 26 beneath the second plenum 42 and can be formed shorter and/or considerably thinner than the associated sealing groove 26 (FIG. 8) for achieving a throttling effect. As a result of this, cooling medium can escape in a directed manner from the second plenum 42 through the gap, which can be sealed with a throttling effect, between adjacent outer platforms 21 into the hot gas passage and can cool the outer platforms. If the sealing strip is thin, provision can be made for corrugations 49, 50 distributed in the base section 48 of the strip which is provided with an additional angled section 47, in order to fix the position of the sealing strip 46 in the sealing groove 26 (FIG. 8).

A stepped gap 45, via which the second plenum 42 is in communication in a directed manner with the hot gas passage 44, can be arranged towards the hot gas passage 44 between a heat shield segment 39—which is adjacent to the outer platform 21 of the stator blade 20, lies opposite a rotor blade 40, and partially delimits the second plenum 42—and the outer platform 21. The geometry of the stepped gap 45 in this case can be such that by two gap widths s1 and s2 and a distance x (FIG. 7), wherein s1 can lie within the range of between 0.1 and 2 mm, s2 lies between s1 and 0.1 to 1 mm, and x lies within the range of between 0.2 mm and 7 mm.

It will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

10 Gas turbine
11 Compressor
12, 16 Fuel supply
13 EV burner
14, 17 Combustion chamber
15 High-pressure turbine
18 Low-pressure turbine
19 Axis
20, 20' Stator blade
21 Outer platform
22 Blade airfoil
23 Blade tip
24, 25 Fastening element (hook-like)
26 Sealing groove
27 Leading edge
28 Trailing edge
29 Suction side
30 Hot gas flow
31 Hollow
32 Core exit
34 Throttling element
35, 35*a*, 43 Throttling openings
36 Inlet
37 Joint face
38 Blade carrier (casing)
39 Heat shield segment
40 Rotor blade
41, 42 Plenum
44 Hot gas passage
45 Stepped gap
46 Sealing strip (L-shaped)
47 Angled section
48 Base section
49, 50 Corrugation
51, 51*a*-51*d* Cooling medium
s1, s2 Gap width
x Distance

What is claimed is:

1. A gas turbine comprising:
a stator blade fastened on a blade carrier, the stator blade including:
a blade airfoil which extends inwards in a radial direction from an outer platform into a hot gas passage;
an access in the blade carrier into a first plenum which is arranged above the outer platform for a cooling medium to flow, via an inlet provided in the outer platform into an interior of the stator blade;
a first means for controlling cooling-medium pressure in the first plenum; and
a second means for cooling the outer platform by directing the cooling medium from the first plenum.

2. The gas turbine as claimed in claim 1, wherein the first means are arranged in a region of the first plenum.

3. The gas turbine as claimed in claim 2, wherein the first means comprises:
a throttling element for throttling a flow of cooling medium through the inlet in the outer platform.

4. The gas turbine as claimed in claim 3, wherein the throttling element is formed as a plate which covers the inlet except for at least one throttling opening which is provided in the plate.

5. The gas turbine as claimed in claim 4, wherein the throttling opening is circular.

6. The gas turbine as claimed in claim 4, wherein the access to the first plenum is formed as at least one throttling opening.

7. The gas turbine as claimed in claim 4, comprising:
outwardly projecting, hook-like fastening elements, for fastening the stator blade on the blade carrier, the fastening elements being formed on an upper side of the outer platform at a distance from each other, and the first plenum being formed between two fastening elements.

8. The gas turbine as claimed in claim 3, wherein the access to the first plenum is formed as at least one throttling opening.

9. The gas turbine as claimed in claim 3, comprising:
outwardly projecting, hook-like fastening elements, for fastening the stator blade on the blade carrier, the fastening elements being formed on an upper side of the outer platform at a distance from each other, and the first plenum being formed between two fastening elements.

10. The gas turbine as claimed in claim 2, wherein the access to the first plenum is formed as at least one throttling opening.

11. The gas turbine as claimed in claim 2, comprising:
outwardly projecting, hook-like fastening elements, for fastening the stator blade on the blade carrier, the fastening elements being formed on an upper side of the outer platform at a distance from each other, and the first plenum being formed between two fastening elements.

12. The gas turbine as claimed in claim 1, wherein the access to the first plenum is formed as at least one throttling opening.

13. The gas turbine as claimed in claim 12, comprising:
outwardly projecting, hook-like fastening elements, for fastening the stator blade on the blade carrier, the fastening elements being formed on an upper side of the outer platform at a distance from each other, and the first plenum being formed between two fastening elements.

14. The gas turbine as claimed in claim 1, comprising:
outwardly projecting, hook-like fastening elements, for fastening the stator blade on the blade carrier, the fastening elements being formed on an upper side of the outer platform at a distance from each other, and the first plenum being formed between two fastening elements.

15. The gas turbine as claimed in claim 14, wherein the second means comprises:
a second plenum arranged on a side of one fastening element opposite from the first plenum, for receiving cooling medium which escapes from the first plenum, the second plenum being in fluid communication with the hot gas passage via throttling means.

16. The gas turbine as claimed in claim 15, comprising:
sealing strips which seal gaps which exist between adjacent stator blades of a stator blade row against the hot gas passage, the sealing strips being inserted in corresponding sealing grooves in lateral surfaces of the outer platforms of plural stator blades, and the sealing strips being formed as throttling means in a region of the second plenum.

17. The gas turbine as claimed in claim 16, wherein the sealing strips in the region of the second plenum are formed at least one of shorter and thinner than associated sealing grooves for achieving a throttling effect.

18. The gas turbine as claimed in claim 17, comprising:
a heat shield segment which partially delimits the second plenum of a stator blade, the heat shield segment being adjacent to the outer platform of the stator blade in a flow direction of a hot gas flow; and a stepped gap, via which the second plenum is in communication with the hot gas passage, being arranged between the heat shield segment and the outer platform towards the hot gas passage.

19. The gas turbine as claimed in claim 15, comprising:

a heat shield segment which partially delimits the second plenum, the heat shield segment being adjacent to the outer platform of the stator blade in a flow direction of a hot gas flow; and a stepped gap, via which the second plenum is in communication with the hot gas passage, being arranged between the heat shield segment and the outer platform towards the hot gas passage.

* * * * *